United States Patent [19]

Groothoff

[11] Patent Number: 5,023,510

[45] Date of Patent: Jun. 11, 1991

[54] PICTURE TUBE HAVING AN ELECTRO-MAGNETIC DEFLECTION UNIT

[75] Inventor: Adriaan J. Groothoff, Eindhoven, Netherlands

[73] Assignee: U.S. Philips Corporation, New York, N.Y.

[21] Appl. No.: 354,006

[22] Filed: May 19, 1989

[30] Foreign Application Priority Data

Jun. 20, 1988 [NL] Netherlands ..... 8801566

[51] Int. Cl.[5] ..... H01J 29/70

[52] U.S. Cl. ..... 313/440; 335/212

[58] Field of Search ..... 313/440; 358/248, 249; 335/212

[56] References Cited

U.S. PATENT DOCUMENTS

| | | | |
|---|---|---|---|
| 3,189,775 | 6/1965 | Fyler | 358/254 X |
| 3,671,894 | 6/1972 | Sawada | 358/248 X |
| 4,060,836 | 11/1977 | Corbeij et al. | 358/248 |
| 4,117,516 | 9/1978 | Yasuhara | 358/248 |
| 4,261,017 | 4/1981 | Branton | 358/248 |
| 4,554,589 | 11/1985 | Cormio | 358/248 |

*Primary Examiner*—Donald J. Yusko
*Assistant Examiner*—Michael Horabik

[57] ABSTRACT

The invention relates to a deflection unit (4) of a picture tube, the deflection unit (4) comprising a coil holder (5) and a cylindrical connection member (6) with elastic tongues. The cylindrical connection member (6) is flexibly connected to the coil holder by means of connection members (14) so that in a simple way the coil holder is tiltable around two mutually perpendicular axes which are each perpendicular to the longitudinal axis (12) of the coil holder (5).

6 Claims, 3 Drawing Sheets

PICTURE TUBE HAVING AN ELECTRO-MAGNETIC DEFLECTION UNIT

Figure 1:
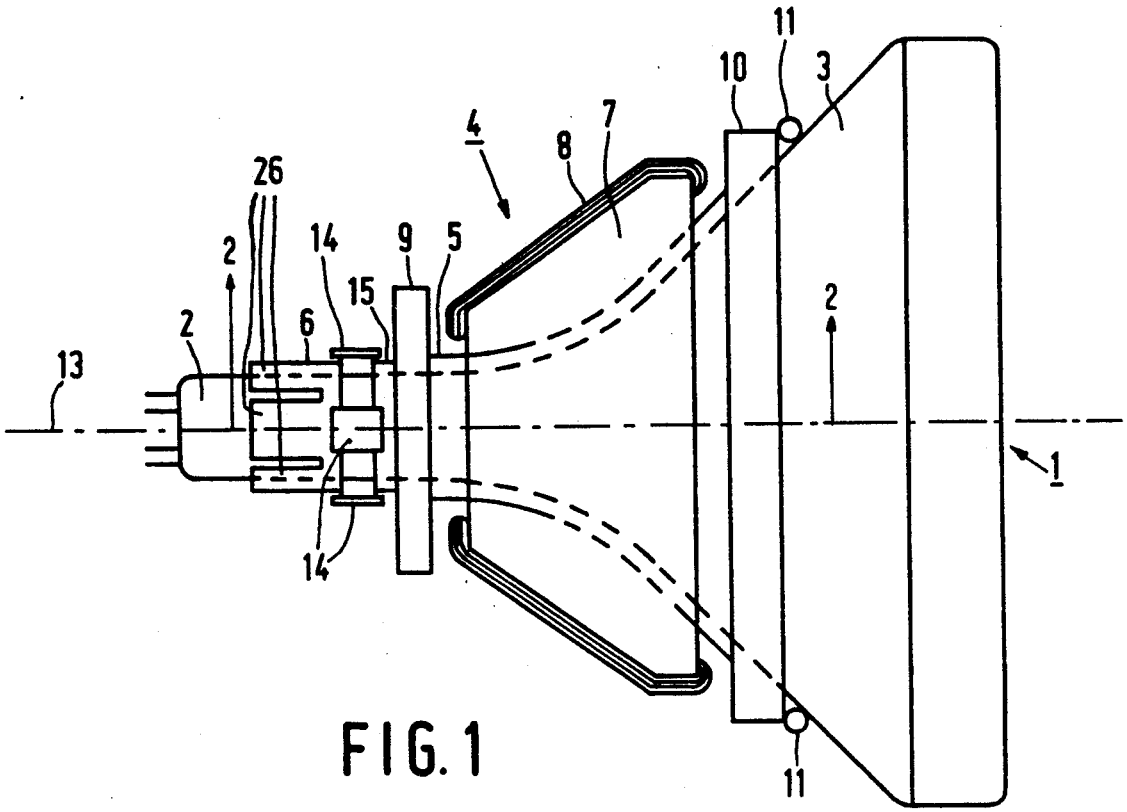

The invention relates to a picture tube having an electro-magnetic deflection unit comprising deflection coils which are supported by a coil holder disposed on the picture tube, the narrow end of the coil holder being clamped by means of a cylindrical connection member onto the neck of the picture tube and the flared end of the coil holder being positioned on the funnel-shaped envelope portion of the picture tube and the coil holder being tiltable around two mutually perpendicular axes which are each perpendicular to the longitudinal axis of the coil holder.

In practice it was found that more specifically for colour picture tubes having three electron guns in one plane, it being possible to obtain a good dynamic convergence by an appropriate choice of the shape of the deflection fields generated by the deflection coils without the use of additional auxiliary means, residual errors can yet occur in the dynamic convergence. These residual errors are caused by the fact that due to manufacturing tolerances during the assembly of the picture tube and the electro-magnetic deflection unit the axes of the deflection fields and the picture tube do not always coincide. It was found that these residual errors can be corrected by tilting the deflection unit around two mutually perpendicular axes which each extend perpendicularly to the axis of the funnel-shaped coil holder, until the axes of the picture tube and the deflection unit coincide at least substantially.

A picture tube provided with an electro-magnetic deflection unit of the type defined in the opening paragraph, in which the coil holder is tiltable around two mutually perpendicular axes relative to the axis of the coil holder is disclosed in U.S. Pat. No. 4,060,836. The deflection unit described therein includes a coil holder which is enveloped by a housing having a cylindrical portion with axial tongues. The coil holder is connected to the housing via a ball joint. This deflection unit requires a plurality of components, which increases the cost price of the deflection unit. In addition, the housing enveloping the coil holder occupies much space, so that handling of the deflection unit becomes less easy.

The invention has for its object to provide a deflection unit comprising fewer of components, the coil holder being tiltable around two mutually perpendicular axes in a simple manner.

A picture tube having an electro-magnetic deflection unit of a type defined in the opening paragraph, is characterized in that the cylindrical member is flexibly connected to the narrow end of the coil holder with the aid of connection members which are positioned as diametrically opposite pairs on each axis. The flexible connection provided by virtue of said connection members allows tilting of the coil holder relative to the cylindrical connection member in a simple way. When the inner diameter of the narrow end exceeds the inner diameter of the cylindrical connection member, the risk of the coil holder colliding with the picture tube is reduced, whereby a restriction of the tiltability is prevented. An additional advantage of the flexible connection is that no harmful stresses are produced in the coil holder during tilting.

An embodiment of a picture tube according to the invention, is characterized in that, the cylindrical connection member is flexibly connected to an annular intermediate member by means of two connection members which are located substantially opposite to each other, and the annular intermediate member is flexibly connected to the narrow end by means of two further connection members which, taken in a direction along the periphery of the intermediate member are shifted substantially through 90° relative to said first connection members and are located substantially opposite each other. Thus, the coil holder is tiltable in a simple manner around two mutually perpendicular axes which each extend perpendicular to the longitudinal axis of the coil holder. The annular intermediate member then provides a separation of the tilting motion around the two axes, as a result of which the correction of the residual errors can occur in a simple way. If the inner diameter of the intermediate member exceeds the inner diameter of the cylindrical connection member the risk of the coil holder colliding with the picture tube is reduced.

A further embodiment of a picture tube according to the invention is characterized in that the connection members are partly cylindrical elements whose longitudinal axes extend substantially parallel to the axis of the coil holder. This ensures that the flexible connection has adequate stiffness. In addition, these connection members offer the possibility to manufacture the cylindrical connection member and the coil holder in one single manufacturing step.

An embodiment of a picture tube according to the invention is characterized in that the narrow end of the coil holder is provided with two partly cylindrical elements which each have a longitudinal axis that extends substantially parallel to the axis of the coil holder and which are positioned diametrically opposite each other on a first axis which extends perpendicularly to the axis of the coil holder, the partly cylindrical elements being provided at the side remote from the flared end of the coil holder with an annular intermediate member, the intermediate member having two further partly cylindrical elements which each have a longitudinal axis that extends substantially parallel to the axis of the annular intermediate member and which are provided diametrically opposite each other on a second axis, the second axis extending perpendicularly to the first axis and perpendicularly to the axis of the annular intermediate member, these further partly cylindrical elements being provided at the side remote from the flared end of the coil holder with the cylindrical connection member. This embodiment is of a simple construction and provides the possibility to fix the adjusted tilt in a simple manner.

Figure 2:
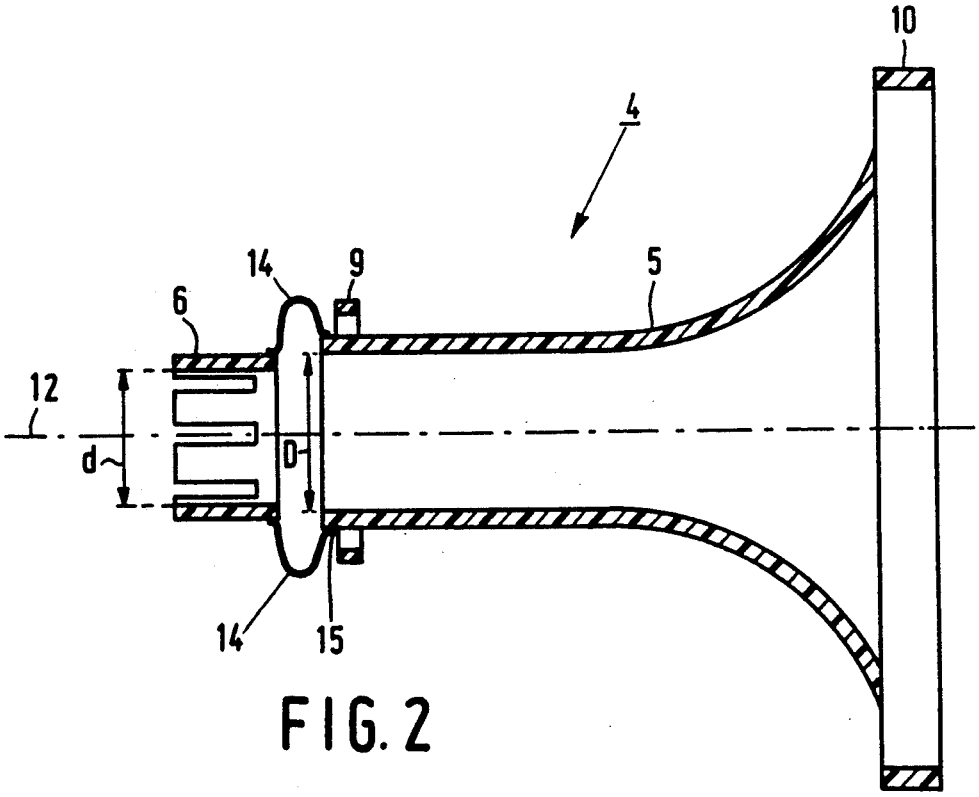
Figure 3:
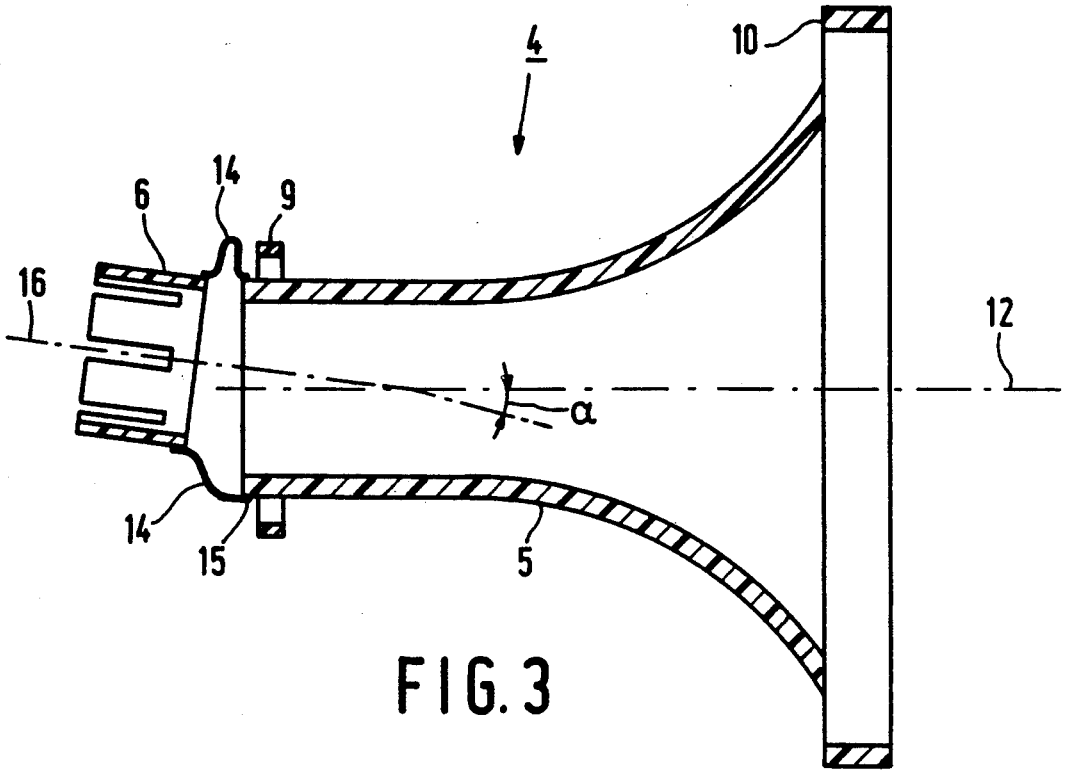
Figure 4:
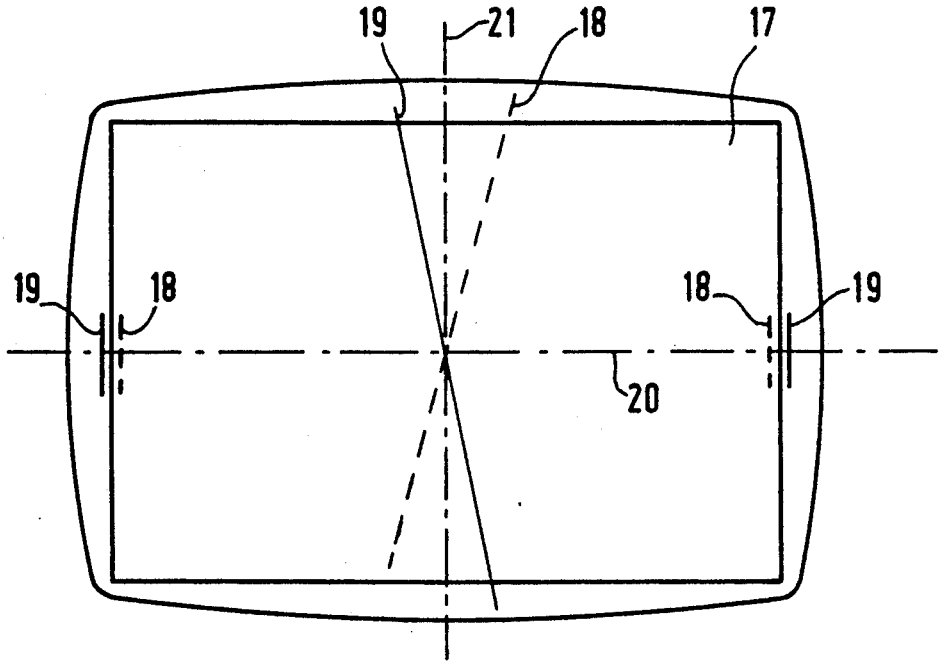
Figure 5:
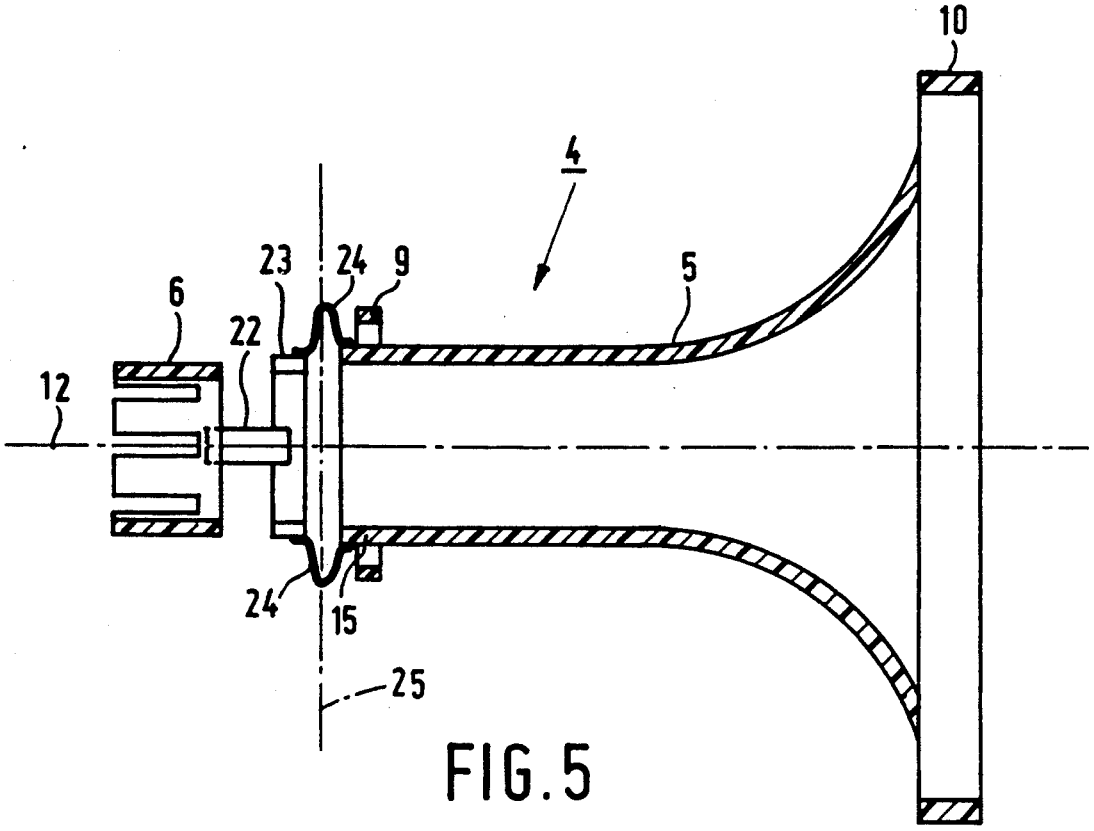
Figure 6:
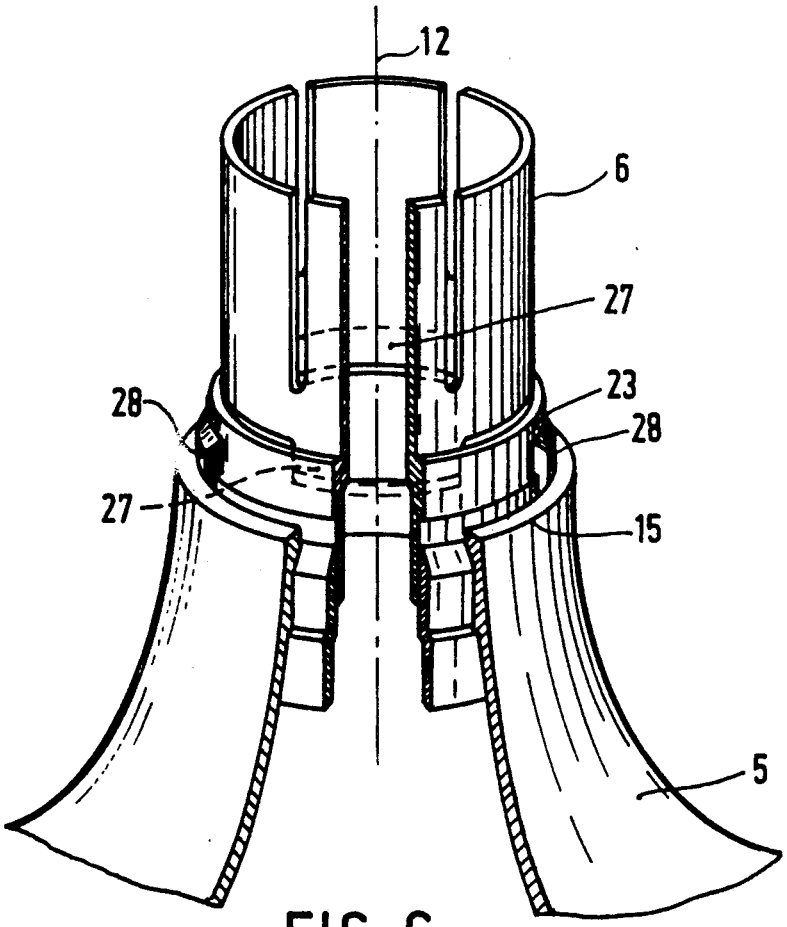

Embodiments of a picture tube according to the invention will now be described by way of non-limitative example with reference to the accompanying drawings, in which FIG. 1 is a view of a picture tube having a deflection unit according to the invention, FIG. 2 is a longitudinal cross-sectional view taken on the line II—II of the deflection unit of FIG. 1, without the picture tube and the coils, FIG. 3 is a longitudinal cross-sectional view of a deflection unit in which the axis of the coil holder is at an angle with the axis of the cylindrical member, FIG. 4 is a representation of a picture screen of a picture tube to illustrate the residual errors in the convergence, FIG. 5 is a longitudinal cross-section of a deflection unit having an annular intermediate member, and FIG. 6 is a partly cut-away view of a deflection unit with annular intermediate member.

FIG. 1 shows schematically a picture tube 1 having a cylindrical neck 2 and a flaring envelope portion 3. In the region of the transition between these two portions an electro-magnetic deflection unit 4 is provided around the picture tube 1. This deflection unit 4 comprises a funnel-shaped coil holder 5 which is made of an electrically insulating synthetic resin material and fits by means of a cylindrical connection member 6 provided with elastic tongues 26 around the neck 2 and is clamped around the neck by means of a clamping strip (not shown). At the exterior side the coil holder 5 is surrounded by an annular ferro-magnetic core 7 having a pair of toroidal deflection coils 8 and at the interior side the coil holder 5 is provided with saddle deflection coils (not shown). The heads of the saddle deflection coils are located in hollow spaces formed in the flanges 9, 10 which are shaped at the coil holder 5. The flaring end of the coil holder 5 in the region of the flange 10 is positioned on the funnel-shaped envelope portion 3 and connected thereto with, for example, the aid of a curable synthetic resin material 11.

FIG. 2 shows schematically a longitudinal section along the line II—II of the deflection unit 4 shown in FIG. 1, the coils having been omitted for the sake of clarity.

So as to obtain an adequately operating picture tube it is important for the axis 12 of the deflection unit 4 to coincide substantially with the axis 13 of the picture tube 1 (see FIG. 1) when the deflection unit is fitted on the picture tube. Simply placing the deflection unit on the picture tube may result in residual errors in a picture to be displayed by the picture tube, due to manufacturing tolerances (see the description given with reference to FIG. 4).

These residual errors can be corrected by tilting the axis of the deflection unit relative to the axis of the picture tube which is possible because of the fact that the coil holder is tiltable around two mutually perpendicular axes which are each perpendicular to the longitudinal axis of the coil holder. According to the invention, the possibility of tilting the deflection unit can be obtained in a simple manner by connecting the cylindrical connection member 6 by means of connection members 14 which are positioned on each of two mutually perpendicular axes which are perpendicular to the axis of the coil holder as diametrically opposite pairs, to the narrow end 15 of the coil holder 5, the inner diameter d of the cylindrical connection member 6 preferably being less than the inner diameter D of the narrow end ($d<D$). Thus, the axis 12 of the coil holder 5, which axis 12 substantially coincides with the axis of the deflection unit 4, can tilt relative to the axis 16 of the cylindrical connection member 6 (FIG. 3).

FIG. 3 shows schematically a longitudinal section of a deflection unit 4 in which the axis of the cylindrical connection member 6 is at an angle $\alpha$ with the axis 12 of the coil holder 5. This angle $\alpha$ is adjustable because of the fact that the connecting members 14 form a flexible connection between the cylindrical connection member 6 and the coil holder 5. The connection members 14 may be of many different types capable of producing a flexible connection. Thus, the connection members 14 may be constituted by partly cylindrical, flexible strips such as the resilient strips shown schematically in FIG. 1, or by curved elastic elements as shown schematically in the FIGS. 2 and 3.

The tiltability thus obtained of the axis 12 of the coil holder 5 relative to the axis 16 of the cylindrical connection member 6 also provides a tilting capability of the deflection unit relative to the axis of the picture tube. The deflection unit is positioned on the picture tube, the cylindrical connection member of the deflection unit being clamped onto the neck of the picture tube. Consequently, the axis of the cylindrical connection member coincides substantially with the axis of the neck, which coincides at least substantially with the axis of the picture tube. To prevent that, on tilting of the coil holder after the deflection unit has been disposed on the picture tube, the narrow end 15 may contact the picture tube, which consequently would restrict the tilting motion, the inner diameter d of the cylindrical connection member 6 is preferably less than the inner diameter (D) of the narrow end 15.

FIG. 4 shows schematically a picture screen 17 of a picture tube having three in-line electron guns, the central gun generating an electron beam which is incident on the green phosphor elements on the picture screen 17, whilst the electron beams of the two outer guns are incident on the red and blue phosphor elements, respectively. Three pairs of lines are shown on the picture screen 17, which are each formed by a red line 18 and a blue line 19 which for a good operation of the display tube should coincide. When the axis of the picture tube and the axis of the deflection unit do not coincide, the blue and red lines 19 and 18 consequently do not coincide. Convergence errors then occur both at the ends of the horizontal axis 20 of the picture screen 17 and at the ends of the vertical axis 21. It has been found that the errors on the horizontal axis 20 can be corrected by tilting the deflection unit around the vertical axis 21, whilst a correction of the errors on the vertical axis 21 can be obtained by tilting the deflection unit around the horizontal axis 20. A correction of these errors can be effected in a simple manner when these two tilting operations are separated.

FIG. 5 shows schematically an embodiment of a deflection unit in which the axis 12 of the coil holder is separately tiltable around two mutually perpendicular axes. The cylindrical connection member 6 of the deflection unit 4 is flexibly connected to an annular intermediate member 23 via two connection members 22 (one of which is shown in the drawing) which are substantially opposite each other. The annular intermediate member 23 is flexibly connected to the narrow end 15 by means of two further connection members 24 which substantially face each other. The connection members 22 are shifted through 90° along the periphery of the intermediate member 23 relative to the further connection members 24. Consequently, the axis of the cylindrical connection member 6 is tiltable relative to the axis of the intermediate member 23 about an axis which extends substantially through the centres of the connection members 22 (in this case perpendicularly to the plane of the drawing) and are separately tiltable relative to the axis 25 of the coil holder 5 about the axis which extends substantially through the centres of the further connection members 24 (in the present case in the plane of the drawing). So as to prevent the tiltability from being limited, the inner diameters of the annular intermediate member 23 and the end 15 must preferably be greater than that of the cylindrical connection member 6. When the further connection members 24 are positioned such on the intermediate member 23 such that the axis 25 extends substantially parallel to the axis 20 or 21 of the picture screen 17 (FIG. 4) then it is easy to correct the residual errors by tilting the axis of the coil holder 5 to a desired position relative to the axis of the picture tube with the aid of the flexible connection. Then the cylindrical connection member 6 continues to be in an appropriate contact with the picture tube neck and the flexible connection at the same time prevents any harmful stresses in the coil holder due to the tilting operation from occurring.

Once the desired position of the deflection unit has been set then the deflection unit is secured to the picture tube by clamping the connection member 6 around the neck by means of a clamping strip and by connecting the flaring end to the funnel-shaped envelope portion of the picture tube (see FIG. 1) for example by epoxy which then firmly holds the coil holder in position. This connection must be adequately stable to avoid a drift in the adjusted position. To that end the flexible connection must be adequately stiff, which in the embodiment of a deflection unit of the invention as shown in FIG. 6 is obtained in a simple manner.

FIG. 6 is a schematic view of a portion of the deflection unit, the cylindrical connection member being partly cut away for the sake of clarity. The cylindrical connection member 6 is flexibly connected to the annular intermediate member 23 with the aid of two partly cylindrical elements 27 which are substantially opposite each other (and one of which is shown) and whose longitudinal axes extend substantially parallel to the axis of the coil holder 5.

By means of two partly cylindrical elements 28 which substantially face each other and are similar to the elements 27, the annular member 23 is flexibly connected to the narrow end 15 of the coil holder 5. Depending on the width of the cylindrical elements 27, 28 the connection of the cylindrical connection member 6 to the narrow end does not only accomplish an adequate flexibility but also an adequate stiffness. The design of the deflection unit as shown in FIG. 6 provides the possibility of manufacturing, in one production step, for example by injection moulding, both the cylindrical portion 6, the connection members 27, 28, the annular intermediate member 23 and the coil holder 5 from a synthetic resin material.

It will be obvious that the invention is not limited to the embodiments described but that many variations are possible for a person skilled in the art within the scope of the invention.

I claim:

1. A picture tube assembly comprising a picture tube and an electro-magnetic deflection unit including deflection coils which are supported by a coil holder disposed on the picture tube, which picture tube has a neck and a funnel-shaped envelope portion and which coil holder has a narrow end and a flared end, the narrow end of the coil holder being clamped by means of a cylindrical connection member onto the neck of the picture tube and the flared end of the coil holder being positioned on the funnel-shaped envelope portion of the picture tube and the coil holder being tiltable around first and second mutually perpendicular axes, each of which is perpendicular to a longitudinal axis of the coil holder, characterized in that the cylindrical connection member is flexibly connected to the narrow end of the coil holder with the aid of connection members which are positioned as diametrically opposite pairs on each of said first and second axes.

2. A picture tube assembly as claimed in claim 1, characterized in that an inner diameter of the cylindrical connection member is less than an inner diameter of the narrow end of the coil holder.

3. A picture tube assembly as claimed in claim 1, characterized in that the cylindrical connection member is flexibly connected to an annular intermediate member by means of a first pair of said connection members which are substantially opposite to each other and the annular intermediate member is flexibly connected to the narrow end of the coil holder by means of a second pair of said connection members which, taken in a direction along the periphery of the intermediate member, are shifted substantially through 90° relative to said first connection members and are located substantially opposite each other.

4. A picture tube assembly as claimed in claim 3, characterized in that an inner diameter of the annular intermediate member exceeds that of the cylindrical connection member.

5. A picture tube assembly as claimed in claims 1, or 3, characterized in that the connection members are partly cylindrical elements whose longitudinal axes are substantially parallel to the longitudinal axis of the coil holder.

6. A picture tube assembly as claimed in claim 1, characterized in that the narrow end of the coil holder is provided with a pair of said connection members in the form of two partly cylindrical elements which have a longitudinal axis which extends substantially parallel to the longitudinal axis of the coil holder and are positioned diametrically opposite each other on a first axis which extends perpendicularly to the longitudinal axis of the coil holder, the partly cylindrical elements being provided at the side remote from the flared end of the coil holder with an annular intermediate member, the intermediate member having a further a pair of said connection members in the form of two partly cylindrical elements which have a longitudinal axis which extends substantially parallel to an axis of the annular intermediate member and are positioned diametrically opposite each other on a second axis, the second axis extending perpendicularly to the first axis and perpendicularly to the axis of the annular intermediate member, these further partly cylindrical elements being provided at the side remote from the flared end of the coil holder with the cylindrical connection member.

* * * * *